United States Patent [19]

Bailey et al.

[11] Patent Number: 4,927,803

[45] Date of Patent: May 22, 1990

[54] THERMAL DYE TRANSFER RECEIVING LAYER OF POLYCARBONATE WITH NONAROMATIC DIOL

[75] Inventors: David B. Bailey, Webster; Daniel J. Harrison; Paul D. Yacobucci, both of Rochester, all of N.Y.

[73] Assignee: Eastman Kodak Company, Rochester, N.Y.

[21] Appl. No.: 345,049

[22] Filed: Apr. 28, 1989

[51] Int. Cl.[5] ..... B41M 5/035; B41M 5/26

[52] U.S. Cl. ..... 503/227; 8/471; 428/195; 428/412; 428/913; 428/914

[58] Field of Search ..... 8/471; 428/195, 340–342, 428/412, 913, 914; 503/227

[56] References Cited

U.S. PATENT DOCUMENTS 4,740,497 4/1988 Harrison et al. ..... 503/227

FOREIGN PATENT DOCUMENTS 19138 1/1985 Japan ..... 503/227

*Primary Examiner*—Bruce H. Hess

*Attorney, Agent, or Firm*—Harold E. Cole

[57] ABSTRACT

A dye-receiving element for thermal dye transfer comprising a support having thereon a polymeric dye image-receiving layer containing a polycarbonate having a $T_g$ from about 40° C. to about 100° C. and having the following formula:

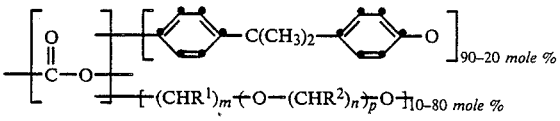

wherein $R^1$ and $R^2$ each independently represents hydrogen, methyl or ethyl;

m and n each independently represents an integer from 2 to 10; and p is an integer from 0 to 6.

18 Claims, No Drawings

THERMAL DYE TRANSFER RECEIVING LAYER OF POLYCARBONATE WITH NONAROMATIC DIOL

This invention relates to dye-receiving elements used in thermal dye transfer, and more particularly to the use of a particular polycarbonate dye image-receiving layer to improve the dye density transfer.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

U.S. Pat. No. 4,740,497 relates to the use of a mixture of poly(caprolactone) and a polycarbonate as the dye image-receiving layer in a thermal dye transfer element. JP 60/19,138 relates to the use of an image-receiving layer comprising a polycarbonate and a plasticizer. There is a problem with the polycarbonates of the prior art in that the dye transfer density is not always as great as it should be, especially after incubation. It would be desirable to provide polycarbonates which would provide increased dye density upon transfer and which would decrease as little as possible upon keeping.

These and other objects are achieved in accordance with this invention which comprises a dye-receiving element for thermal dye transfer comprising a support having thereon a polymeric dye image-receiving layer, and wherein the dye image-receiving layer comprises a polycarbonate having a $T_g$ from about 40° C. to about 100° C. and having the following formula:

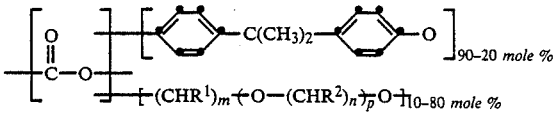

wherein $R^1$ and $R^2$ each independently represents hydrogen, methyl or ethyl;

m and n each independently represents an integer from 2 to 10; and p is an integer from 0 to 6.

In a preferred embodiment of the invention, $R^1$ in the above formula is hydrogen. In another preferred embodiment, p is 0, $R^1$ is hydrogen, and m is 5 or 6. In yet another preferred embodiment, p is 1 or 2, $R^1$ and $R^2$ are each hydrogen, and m and n are each 2. In still another preferred embodiment, p is 1 or 3, $R^1$ and $R^2$ are each hydrogen, and m and n are each 2 or 3.

The polycarbonates of the invention are prepared by modifying a bisphenol-A polycarbonate with a linear aliphatic diol having the following structure:

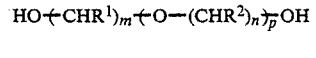

wherein p, $R^1$, $R^2$, m and n are defined as above.

Specific examples of polycarbonates included within the scope of the invention include the following:

Polycarbonate 1: A bisphenol-A polycarbonate modified with 50 mole % 1,5-pentanediol (Tg=64° C.)

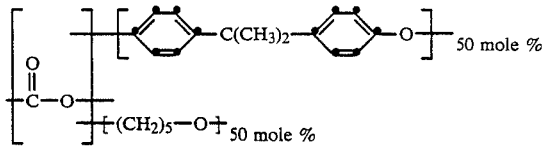

Polycarbonate 2: A bisphenol-A polycarbonate modified with 50 mole % 1,6-hexanediol (Tg=52° C.)

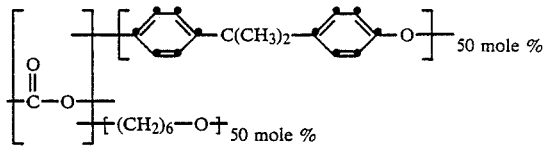

Polycarbonate 3: A bisphenol-A polycarbonate modified with 50 mole % 3-oxa-1,5-pentanediol (Tg=74° C.)

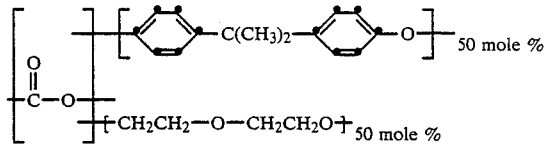

Polycarbonate 4: A bisphenol-A polycarbonate modified with 50 mole % 3,6-dioxa-1,8-octanediol (Tg=75° C.)

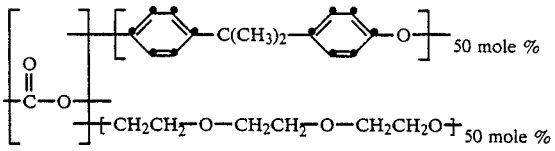

Polycarbonate 5: A bisphenol-A polycarbonate modified with 25 mole % 3,6,9-trioxa-1,11-undecanediol (Tg=87° C.).

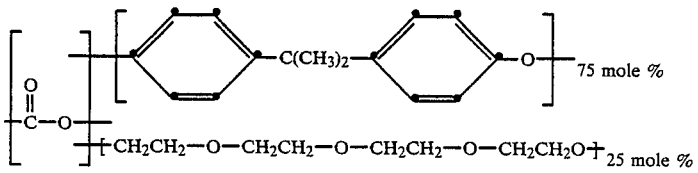

Polycarbonate 6: A bisphenol-A polycarbonate modified with 50 mole % 4-oxa-2,6-heptanediol (Tg=66° C.)

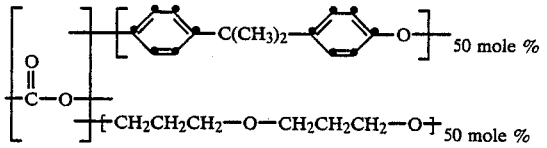

The dye image-receiving layer may be present in any amount which is effective for the intended purpose. In general, good results have been obtained at a concentration of from about 1 to about 10 g/m$^2$.

The above-described dye image-receiving layer may also be employed as an overcoat layer on another dye-receiving layer, such as those described in U.S. Pat. No. 4,775,657.

The support for the dye-receiving element of the invention may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as duPont Tyvek®. In a preferred embodiment, polyethylene-coated paper is employed. It may be employed at any thickness desired, usually from about 50 μm to about 1000 μm.

A dye-donor element that is used with the dye-receiving element of the invention comprises a support having thereon a dye layer. Any dye can be used in such a layer provided it is transferable to the dye image-receiving layer of the dye-receiving element of the invention by the action of heat. Especially good results have been obtained with sublimable dyes. Examples of sublimable dyes include anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

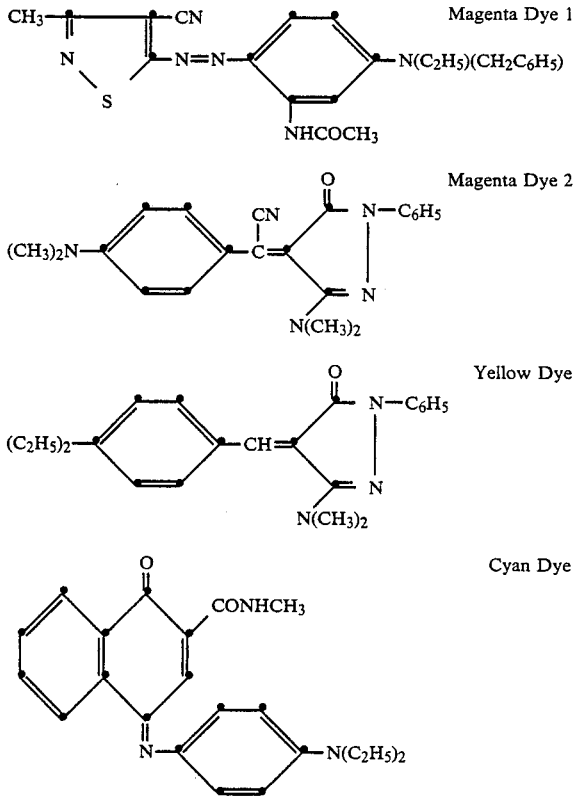

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 2 to about 30 μm. It may also be coated with a subbing layer, if desired.

A dye-barrier layer comprising a hydrophilic polymer may also be employed in the dye-donor element between its support and the dye laser which provides improved dye transfer densities. Such dye-barrier layer materials include those described and claimed in U.S. Pat. No. 4,700,208 of Vanier et al, issued Oct. 13, 1987.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), silicone oil, poly(tetrafluoroethylene), carbowax, poly(ethylene glycols), or any of those materials disclosed in U.S. Pat. Nos. 4,717,711 of Vanier, Harrison and Kan; 4,717,712 of Harrison, Vanier and Kan; 4,737,485 of Henzel, Lum and Vanier; and 4,738,950 of Vanier and Evans. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

As noted above, dye-donor elements are used to form a dye transfer image. Such a process comprises image-wise-heating a dye-donor element and transferring a dye image to a dye-receiving element as described above to form the dye transfer image.

The dye-donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651 of Moore, Weaver and Lum; 4,685,287 of Evans and Lum; 4,701,439 of Weaver, Moore and Lum; 4,757,046 of Byers and Chapman; 4,743,582 of Evans and Weber; 4,769,360 of Evans and Weber; and 4,753,922 of Byers, Chapman and McManus, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements employed in the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

Preparation of Polycarbonate 3

Bisphenol-A bischloroformate (178. g, 0.5 mole), dried distilled diethyleneglycol (3-oxa-1,5-pentanediol) (53.1 g, 0.5 mole), and dichloromethane (1000 mL) were added to a reaction flask and mixed with stirring under nitrogen taking care to assure the absence of water. The mixture was cooled to 5° C. over 60 min and the temperature was maintained while pyridine (125. mL, 1.6 mole) was slowly added over 125 min. After an additional 60 min the solution was warmed to room temperature. Small portions of bisphenol-A-bischloroformate (1.8 g, 0.005 mole) dissolved in dichloromethane (15 ml) were slowly added at room temperature. About 15 min after each addition, the viscosity was estimated visually and addition of the bisphenol-A-bischloroformate was carefully continued just until the viscosity began to increase avoiding production of a yellow color. The reaction mixture was washed with 2% hydrochloric acid and water and was then treated with methanol. The solution was diluted with dichloromethane (to 2 L), washed vigorously with water for 5 min with stirring, and allowed to stand for 20 minutes. The top layer was removed, and the lower organic phase was washed three times with 2% hydrochloric acid (2 L), and seven times with water (4 L). As required to decrease emulsification, dichloromethane (1000 mL) was added to the fourth water wash, and acetone (400 mL) was added to the fifth water wash. After setting overnight, the bottom layer was separated and placed in a freezer two days. A ten-fold volume of methanol was slowly added over a period of hours to precipitate the polymer, which was separated and soaked in methanol (4 L) to give shredded strands. The polymer was squeeze dried on a filter funnel and room temperature air dried at reduced pressure under a nitrogen bleed. The product had an estimated mw of 130,000.

EXAMPLE 2

A dye-donor of alternating sequential areas of cyan, magenta and yellow dye was prepared by coating on a 6 μm poly(ethylene terephthalate) support:

(1) a subbing layer of a titanium alkoxide (duPont Tyzor TBT ®) (0.12 g/m$^2$) from a n-propyl acetate and n-butyl alcohol solvent mixture, and (2) a dye layer containing the cyan dye illustrated above (0.42 g/m$^2$), a magenta dye mixture of Magenta Dye 1 and Magenta Dye 2 illustrated above (0.09 g/m$^2$ and 0.19 g/m$^2$), or the yellow dye illustrated above (0.20 g/m$^2$), and Shamrock Technologies Inc. S-363 micronized blend of polyethylene, polypropylene and oxidized polyethylene particles (0.02 g/m$^2$), in a cellulose acetate propionate (2.5% acetyl, 45% propionyl) binder (0.41–0.66 g/m$^2$) coated from a toluene, methanol and cyclopentanone solvent mixture.

On the back side of the dye-donor was coated:

(1) a subbing layer of a titanium alkoxide (duPont Tyzor TBT ®) (0.12 g/m$^2$) from a n-propyl acetate and n-butyl alcohol solvent mixture, and (2) a slipping layer of Petrarch Systems PS513 ® amino-terminated polysiloxane (0.006 g/m$^2$); p-toluenesulfonic acid (2.5% of the wt. of the polysiloxane); Emralon 329 ® (Acheson Colloids Corp.) dry film lubricant of poly(tetrafluoroethylene) particles in a cellulose nitrate resin binder (0.54 g/m$^2$); BYK-320 ® (BYK Chemie, USA) copolymer of a polyalkylene oxide and a methyl alkylsiloxane (0.002 g/m$^2$), and Shamrock Technologies Inc. S-232 micronized blend of polyethylene and carnauba wax particles (0.02 g/m$^2$) coated from a n-propyl acetate, toluene, isopropyl alcohol and n-butyl alcohol solvent mixture.

A control dye-receiving element was prepared by coating the following layers in the order recited on a titanium dioxide-pigmented polyethylene-overcoated paper stock:

(1) Subbing layers of poly(acrylonitrile-co-vinylidene chloride-co-acrylic acid) (14:79:7 wt. ratio) (0.08 g/m$^2$) coated from 2-butanone, and (2) Dye-receiving layer of Makrolon 5700 ® (Bayer AG Corporation) polycarbonate resin (2.9 g/m$^2$) (Control 1) coated from a dichloromethane-trichloroethylene solvent mixture.

The Makrolon 5700 ® had the following structure:

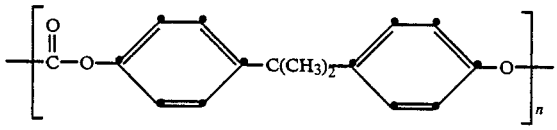

wherein n is from about 100 to about 500.

Other control elements were prepared similar to the one above except that they contained the following polycarbonates:

Control 2: A bisphenol-A polycarbonate modified with 10 mole % ethylene glycol (Tg=151° C.)

Control 3: A bisphenol-A polycarbonate modified with 30 mole % 1,9-nonanediol (Tg=117° C.)

Control 4: A bisphenol-A polycarbonate modified with 50 mole % 1,9-nonanediol (Tg=32° C.)

Control 5: A bisphenol-A polycarbonate modified with 50 mole % 1,12-dodecanediol (Tg=23° C.)

Control 6: A bisphenol-A polycarbonate modified with 15 mole % 4-oxa-2,6-heptanediol (Tg=124° C.) (similar to Polycarbonate 6, but containing only 15 mole % dipropylene glycol)

Control 7: A bisphenol-A polycarbonate modified with 20 mole % 4-oxa-2,6-heptanediol (Tg=113° C.) (similar to Polycarbonate 6, but containing only 20 mole % dipropylene glycol)

Control 8: A bisphenol-A polycarbonate modified with 50 mole % 3-thia-1,5-pentanediol (Tg=57° C.)

Control 9: A bisphenol-A polycarbonate modified with 50 mole % 4,4'-oxydiphenol (Tg=141° C.)

Dye-receiving elements according to the invention were prepared similar to the control elements except that they contained Polycarbonates 1–6 as illustrated above.

The dye side of the dye-donor element strip approximately 10 cm×13 cm in area was placed in contact with the dye image-receiving layer of the dye-receiver element of the same area. The assemblage was clamped to a stepper-motor driven 60 mm diameter rubber roller and a TDK Thermal Head (No. L-231) (thermostatted at 26° C.) was pressed with a force of 8.0 pounds (3.6 kg) against the dye-donor element side of the assemblage pushing it against the rubber roller.

The imaging electronics were activated causing the donor/receiver assemblage to be drawn between the printing head and roller at 6.9 mm/sec. Coincidentally, the resistive elements in the thermal print head were pulsed for 29 μsec/pulse at 128 μsec intervals during the 33 msec/dot printing time. A stepped density image was generated by incrementally increasing the number of pulses/dot from 0 to 255. The voltage supplied to the print head was approximately 23.5 volts, resulting in an instantaneous peak power of 1.3 watts/dot and a maximum total energy of 9.6 mjoules/dot.

Stepped individual cyan, magenta and yellow images of each dye were obtained by printing from the three dye-donors. The Status A blue, green, and red reflection density of the step nearest 0.5 was read and recorded. In all cases a maximum density of 1.7 or more was obtained showing the receiver polymers effectively accept dye.

The images were then subjected to High-Intensity Daylight fading (HID-fading) for 7 days, 50 kLux, 5400° K., 32° C., approximately 25% RH and the densities were reread. The percent density loss after fade from the intermediate density steps were calculated. The following results were obtained:

TABLE

| Receiver Polymer | $T_g$ (°C.) | Red Init. Dens. | Red % Fade | Green Init Dens. | Green % Fade | Blue Init Dens. | Blue % Fade |
|---|---|---|---|---|---|---|---|
| Control 1 | 160 | 0.55 | 35 | 0.64 | 79 | 0.44 | 85 |
| Control 2 | 151 | 0.59 | 39 | 0.40 | 75 | 0.50 | 83 |
| Control 3 | 117 | 0.63 | 28 | 0.51 | 46 | 0.62 | 38 |
| Control 4 | 32 | 0.65 | 51 | 0.45 | 26 | 0.50 | 24 |
| Control 5 | 23 | 0.63 | 89 | 0.56 | 65 | 0.65 | 80 |
| Control 6 | 124 | 0.64 | 23 | 0.48 | 63 | 0.57 | 60 |
| Control 7 | 113 | 0.62 | 31 | 0.47 | 53 | 0.56 | 49 |
| Control 8 | 57 | 0.60 | 84 | 0.54 | 74 | 0.60 | 81 |
| Control 9 | 141 | 0.59 | 29 | 0.44 | 76 | 0.52 | 73 |
| Polycarb. 1 | 64 | 0.61 | 14 | 0.54 | 15 | 0.59 | 10 |
| Polycarb. 2 | 52 | 0.58 | 10 | 0.56 | 9 | 0.60 | 8 |
| Polycarb. 3 | 74 | 0.60 | 10 | 0.51 | 10 | 0.58 | 10 |
| Polycarb. 4 | 75 | 0.60 | 19 | 0.54 | 18 | 0.58 | 15 |
| Polycarb. 5 | 87 | 0.63 | 20 | 0.53 | 23 | 0.61 | 22 |

TABLE-continued

| Receiver Polymer | $T_g$ (°C.) | Red Init. Dens. | Red % Fade | Green Init Dens. | Green % Fade | Blue Init Dens. | Blue % Fade |
|---|---|---|---|---|---|---|---|
| Polycarb. 6 | 66 | 0.62 | 17 | 0.57 | 15 | 0.64 | 14 |

The above data show the superior stability to light fading using the dye-receiver polymers of the invention as compared to an unmodified bisphenol-A polycarbonate (Control 1). The polymers with glass transition temperatures either above 100° C. or less than approximately 40° C. and/or that are based upon modifying diols with thia linkages or derived from phenols show much poorer intermediate density stability to light fading for the transferred dyes in comparison to the polycarbonates of the invention.

The invention has been described in detail with particular reference to preferred embodiments thereof, but it will be understood that variations and modifications can be effected within the spirit and scope of the invention.

What is claimed is:

1. In a dye-receiving element for thermal dye transfer comprising a support having thereon a polymeric dye image-receiving layer, the improvement wherein said dye image-receiving layer comprises a polycarbonate having a $T_g$ from about 40° C. to about 100° C. and has the following formula:

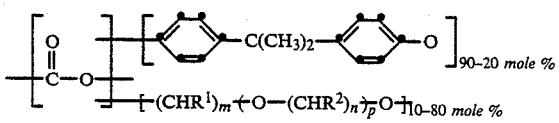

wherein $R^1$ and $R^2$ each independently represents hydrogen, methyl or ethyl;

m and n each independently represents an integer from 2 to 10; and p is an integer from 0 to 6.

2. The element of claim 1 wherein $R^1$ is hydrogen.

3. The element of claim 1 wherein p is 0, $R^1$ is hydrogen, and m is 5 or 6.

4. The element of claim 1 wherein p is 1 or 2, $R^1$ and $R^2$ are each hydrogen, and m and n are each 2.

5. The element of claim 1 wherein p is 1 or 3, $R^1$ and $R^2$ are each hydrogen, and m and n are each 2 or 3.

6. The element of claim 1 wherein said dye image-receiving layer is present at a concentration of from about 1 to about 10 g/m$^2$.

7. In a process of forming a dye transfer image comprising imagewise-heating a dye-donor element comprising a support having thereon a dye layer and transferring a dye image to a dye image-receiving layer of a receiving element to form said dye transfer image, the improvement wherein said dye image-receiving layer comprises a polycarbonate having a $T_g$ from about 40° C. to about 100° C. and has the following formula:

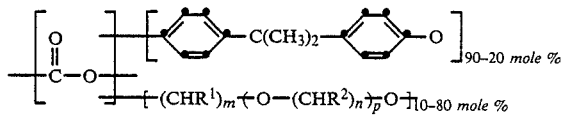

wherein $R^1$ and $R^2$ each independently represents hydrogen, methyl or ethyl;

m and n each independently represents an integer from 2 to 10; and p is an integer from 0 to 6.

8. The process of claim 7 wherein $R^1$ is hydrogen.

9. The process of claim 7 wherein p is 0, $R^1$ is hydrogen, and m is 5 or 6.

10. The process of claim 7 wherein p is 1 or 2, $R^1$ and $R^2$ are each hydrogen, and m and n are each 2.

11. The process of claim 7 wherein p is 1 or 3, $R^1$ and $R^2$ are each hydrogen, and m and n are each 2 or 3.

12. The process of claim 7 wherein said dye image-receiving layer is present at a concentration of from about 1 to about 10 g/m$^2$.

13. In a thermal dye transfer assemblage comprising:

(a) a dye-donor element comprising a support having thereon a dye layer, and (b) a dye-receiving element comprising a support having thereon a polymeric dye image-receiving layer, said dye-receiving element being in a superposed relationship with said dye-donor element so that said dye layer is in contact with said dye image-receiving layer, the improvement wherein said dye image-receiving layer comprises a polycarbonate having a $T_g$ from about 40° C. to about 100° C. and has the following formula:

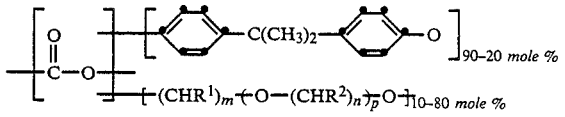

wherein $R^1$ and $R^2$ each independently represents hydrogen, methyl or ethyl;

m and n each independently represents an integer from 2 to 10; and p is an integer from 0 to 6.

14. The assemblage of claim 13 wherein $R^1$ is hydrogen.

15. The assemblage of claim 13 wherein p is 0, $R^1$ is hydrogen, and m is 5 or 6.

16. The assemblage of claim 13 wherein p is 1 or 2, $R^1$ and $R^2$ are each hydrogen, and m and n are each 2.

17. The assemblage of claim 13 wherein p is 1 or 3, $R^1$ and $R^2$ are each hydrogen, and m and n are each 2 or 3.

18. The assemblage of claim 13 wherein said dye image-receiving layer is present at a concentration of from about 1 to about 10 g/m$^2$.

* * * * *